US007056169B1

(12) United States Patent
Lokken et al.

(10) Patent No.: US 7,056,169 B1
(45) Date of Patent: Jun. 6, 2006

(54) CONNECTION DEVICE FOR A MARINE PROPULSION SYSTEM

(75) Inventors: Mark T. Lokken, Oshkosh, WI (US); Michael A. Purdy, Oshkosh, WI (US); Mark R. Hanson, Oshkosh, WI (US); Ronald L. Bates, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 24 days.

(21) Appl. No.: 10/873,086

(22) Filed: Jun. 21, 2004

(51) Int. Cl.
*B63H 5/125* (2006.01)

(52) U.S. Cl. ..... 440/63

(58) Field of Classification Search ..... 440/55, 440/56, 63
See application file for complete search history.

(56) References Cited

U.S. PATENT DOCUMENTS

| | | | | |
|---|---|---|---|---|
| 3,756,186 | A * | 9/1973 | Nordling | 440/63 |
| 4,559,889 | A | 12/1985 | Olson et al. | 114/153 |
| 4,573,930 | A | 3/1986 | Queen | 440/56 |
| 4,778,418 | A | 10/1988 | Mondek | 440/63 |
| 4,826,460 | A | 5/1989 | Zuckerman | 440/55 |
| 5,046,974 | A | 9/1991 | Griffin, Jr. et al. | 440/63 |
| 6,561,860 | B1 | 5/2003 | Colyvas | 440/61 |
| 6,659,817 | B1 | 12/2003 | Anderson et al. | 440/53 |
| 6,699,082 | B1 | 3/2004 | Zeiger | 440/63 |

* cited by examiner

*Primary Examiner*—Lars A. Olson
(74) *Attorney, Agent, or Firm*—William D. Lanyi

(57) ABSTRACT

A connection device for a marine propulsion system is provided in which a selective locking mechanism automatically connects or disconnects two components of the marine propulsion system together in response to rotation of a tube and a rod. This relative rotation of the tube and rod is caused automatically when one of the components of the marine propulsion system is rotated relative to the other component.

27 Claims, 7 Drawing Sheets

CONNECTION DEVICE FOR A MARINE PROPULSION SYSTEM

BACKGROUND OF THE INVENTION

1. Field of the Invention

The present invention is generally related to a connection device for use in a marine propulsion system and, more particularly, to an automatic connection and disconnection device for two or more outboard motors or sterndrive devices in which the components of the marine propulsion system are allowed to move independently about their steering axes when one of the components of the marine propulsion system is in a different positional configuration than the other.

2. Description of the Prior Art

Those skilled in the art of marine propulsion systems are aware of many different ways in which an outboard motor or sterndrive device can be linked to other components, such as other outboard motors or devices that provide motive force to assist in steering a marine vessel. In a common application, two outboard motors are linked together with a tie bar so that they can be rotated about their respective steering axes in a coordinated manner. When one of the outboard motors is trimmed upward to remove its propeller from the water, while the other outboard motor is in its normal position to drive a marine vessel, it is generally necessary to manually change the configuration of the tie bar arrangement so that the outboard motor currently in use for propulsion is able to freely turn about its steering axis without being adversely affected by the other outboard motor which is trimmed out of the water.

U.S. Pat. No. 4,559,889, which issued to Olson et al. on Dec. 24, 1985, describes an outboard motor steering control system. It includes a mounting bracket, torsion bar axially supported on a U-shaped bracket, a foot pedal secured to the torsion bar, and a linkage rod connecting between a pedal bar on the foot pedal to a U-shaped bracket on a motor, whereby the two-bar linkage provides for control of steering of the outboard motor during trolling.

U.S. Pat. No. 4,573,930, which issued to Queen on Mar. 4, 1986, describes steering mechanisms for outboard motors. A remote steering device, adapted for attachment to a main propulsion unit and an auxiliary outboard motor secured to the transom of a boat in order to slave steering movement of the outboard motor to that of the main propulsion unit irrespective of the attitude of the units is described.

U.S. Pat. No. 4,778,418, which issued to Mondek on Oct. 18, 1988, describes a tie bar for a marine propulsion device. The tie bar is used for connecting a pair of marine propulsion devices which are respectively pivotable about spaced vertical axes for steering and about a common horizontal axis for tilting.

U.S. Pat. No. 4,826,460, which issued to Zuckerman on May 2, 1989, describes an outboard marine engine stabilizing device. The device includes a plate having two spaced apart arms which are adapted to be connected to opposite sides of the powerhead of the motor and adapted to be connected to the steering arm of the motor at the end of the plate generally opposite to the location of the connection of the arms to the motor.

U.S. Pat. No. 5,046,974, which issued to Griffin, et al. on Sep. 10, 1991, describes an ancillary tiller for a steerable outboard motor. The tiller provides a first shorter arm releasably interconnectable by mounting structure at its first end to an outboard motor and movably interconnecting by articulating linkage at its second end a second longer elongate arm. The motor mounting structure is adapted for selective interconnection of a motor shaft, tiller or guide grip.

U.S. Pat. No. 6,561,860, which issued to Colyvas on May 13, 2003, describes a maneuvering enhancer for twin outboard motor boats. An adjustable length bar is used to replace a rigid bar, the one connecting the two outboards of the two outdrives of a boat, for steering purposes. The adjustable bar is electrically operated through a switch on the boat's dashboard. A switch has two operating positions, one to keep propellers creating two parallel thrusts and a second to shift the propellers to create a vee configuration.

U.S. Pat. No. 6,659,817, which issued to Anderson et al. on Dec. 9, 2003, discloses an alignment system for an outboard motor. First and second pliable members are each attached to an outboard motor and to a fixed location on the transom or transom bracket associated with the outboard motor. One pliable member is used on the starboard side of the outboard motor while another is used on the port side. As the outboard motor is tilted about its trimmed axis, the two pliable members work in coordination with each other to exert a force on the outboard motor in a direction away from any direction in which the outboard is rotated about its steering axis as it is being tilted about its trim axis.

U.S. Pat. No. 6,699,082, which issued to Zeiger on Mar. 2, 2004, describes a tie bar and mount for boat drives. The configuration connects the drives of a boat together at their centerlines so that the drives are turned at equal angles and are synchronized by the boat's steering system. The tie bar that interconnects the drives includes an end assembly that is configured to rotate 360 degrees with respect to an inner tube.

The patents described above are hereby expressly incorporated by reference in the description of the present invention.

It would be beneficial if a tie bar arrangement could be provided in which the operator of a marine vessel did not have to take specific manual process steps to convert the tie bar from a configuration which locks two components rigidly together and an alternative configuration which allows the two components, such as outboard motors, to rotate independently from each other about their respective steering axes.

SUMMARY OF THE INVENTION

A connection device for a marine propulsion system made in accordance with a preferred embodiment of the present invention comprises first and second members which are configured to be disposed in movable association with each other in a direction generally parallel to a first axis. The first and second members are rotatable relative to each other about a second axis. A selective locking mechanism is configured to prevent relative movement between the first and second members in a direction parallel to the first axis when the first and second members are in a first predetermined rotational position relative to each other about the second axis. The locking mechanism is also configured to permit relative movement between the first and second members in a direction parallel to the first axis when the first and second members are in a second predetermined rotational position relative to each other about the second axis.

The first and second axes can be coaxial with each other and the selective locking mechanism can comprise a pin which is shaped to be received in an opening in order to prevent the relative movement between the first and second members in a direction parallel to the first axis when the first and second members are in a first predetermined rotational position relative to each other about the second axis.

In a particularly preferred embodiment of the present invention, the first and second members are a rod and a tube, respectively, and the opening is a groove which is shaped to receive the pin.

BRIEF DESCRIPTION OF THE DRAWINGS

The present invention will be more fully and completely understood from a reading of the description of the preferred embodiment in conjunction with the drawings, in which:

FIG. 3 is a side view showing an opening formed in a rod of the present invention;

DESCRIPTION OF THE PREFERRED EMBODIMENT

Figure 1:
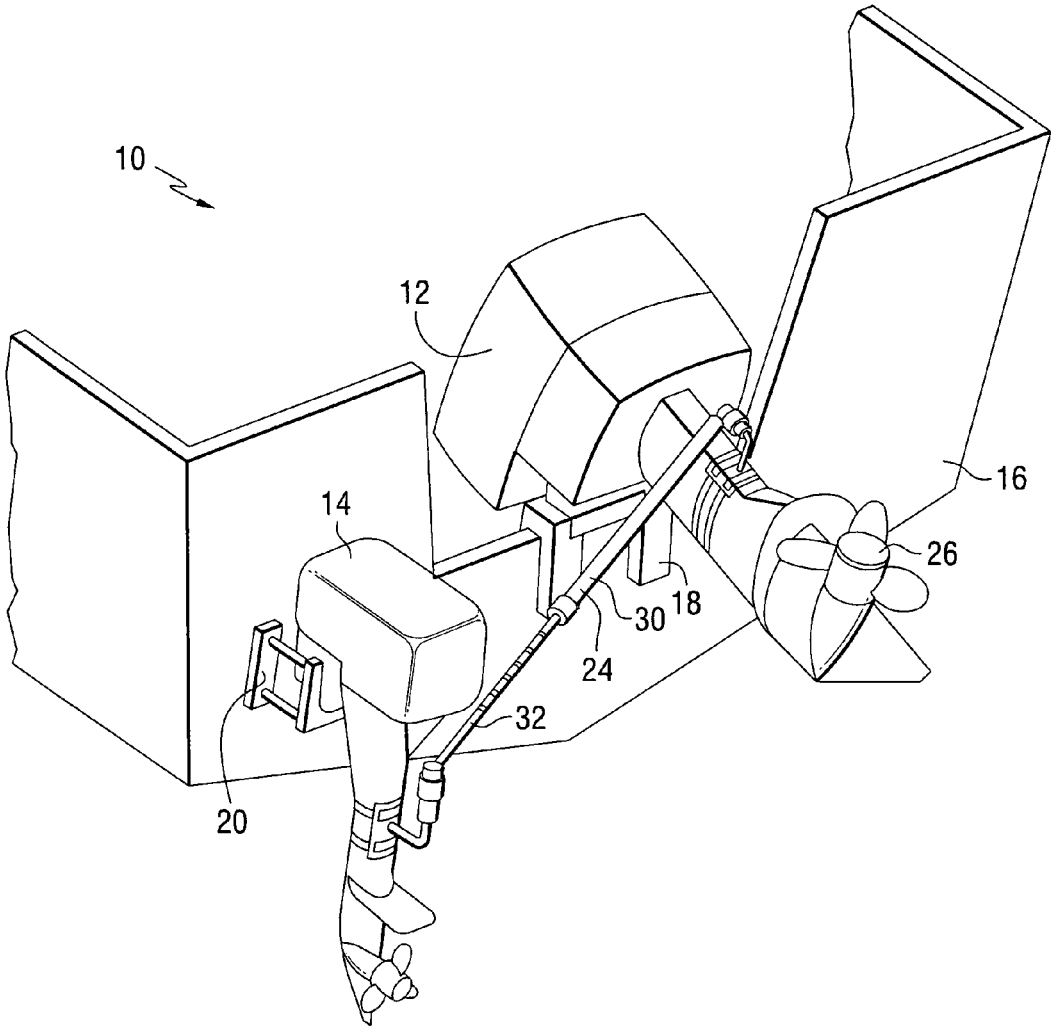
FIG. 1 PRIOR ART
FIG. 1 shows a known type of connection device connected between primary and secondary marine propulsion units.

Throughout the description of the preferred embodiment of the present invention, like components are identified by like reference numerals.

FIG. 1 illustrates a tie bar connection which is generally similar to the arrangement described in U.S. Pat. No. 4,573,930. A marine vessel 10 is provided with a primary marine propulsion unit 12 and a secondary marine propulsion unit 14. The primary marine propulsion unit 12 is attached to the transom 16 of the marine vessel 10 by a primary bracket 18. A secondary bracket 20 is used to attach the secondary marine propulsion unit 14 to the transom 12. The secondary marine propulsion unit 14 is sometimes referred to as a kicker motor and is normally used in situations where the operator of the marine vessel 10 desires to fish at a slower speed than would normally be convenient to provide with the use of the primary marine propulsion unit 12. Between the primary and secondary marine propulsion units, 12 and 14, a tie bar 24 provides a linkage or connection that, in certain circumstances, can cause the two marine propulsion units to move in tandem about their respective steering axes. In FIG. 1, the secondary marine propulsion unit 14 is trimmed downwardly for use as a propulsion device of the marine vessel 10 while the primary marine propulsion unit 12 is trimmed upwardly, with its propeller 26 raised out of the water. The configuration shown in FIG. 1 is typical for use when the operator of the marine vessel 10 desires to fish by using a trolling procedure.

With continued reference to FIG. 1, it should be understood that the present invention is intended to provide an improvement to tie bar arrangements, such as that identified by reference numeral 24, so that the tie bar can automatically disengage the connection between its tubular portion 30 and its rod portion 32 when the primary and secondary marine propulsion units are trimmed to different positions, as shown in FIG. 1. More specifically, the present invention is disengaged when the primary propulsion unit is trimmed down and the secondary propulsion unit is trimmed up. It remains engaged when the primary propulsion unit is trimmed up while the secondary propulsion unit is trimmed down.

FIGS. 2A–2D show section views of a selective locking mechanism which is used in conjunction with the preferred embodiment of the present invention. For purposes of this description of the operation of a preferred embodiment of the present invention, it will be assumed that the tube 41 is attached to the primary propulsion unit and the rod 42 is attached to the secondary propulsion unit. However, it should be understood that an alternative embodiment of the present invention could be configured oppositely to this convention. In addition, it should also be understood that the present invention can be used in conjunction with a single marine propulsion unit which is attached to an alternative motive steering device, such as an electronic steering module.

Figure 2A:
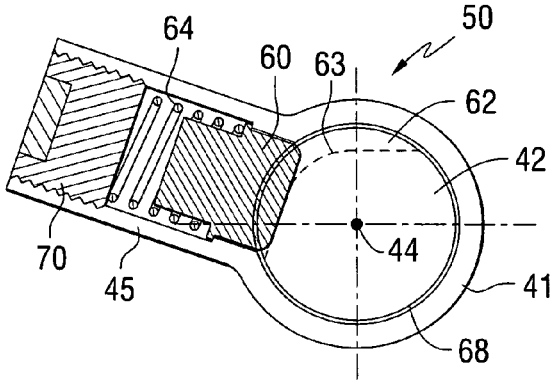
FIGS. 2 and 3 are section views of one embodiment of the present invention.

In FIG. 2A, a rod 42 is disposed within a tube 41. The tube 41 is attachable to a first component of a marine propulsion system, such as the primary marine propulsion unit or outboard motor. The rod 42 is attachable to a second component of the marine propulsion system, such as the secondary marine propulsion unit, or outboard motor. The rod 42 is movable within the tube 41 in a direction which is generally parallel to a central axis 44 of the tube 41. A selective locking mechanism 50 is associated with a connection device in a preferred embodiment of the present invention and is configured to prevent relative movement between the tube 42 and the rod 41 in a direction which is generally parallel to the central axis 44 when the first and second components, or outboard motors, of the marine propulsion system are disposed in a first rotational relationship relative to each other. In a particularly preferred embodiment of the present invention, the selective locking mechanism 50 is configured to prevent this relative axial movement between the tube 42 and the rod 41 whenever the primary outboard motor is trimmed up while the secondary outboard motor is trimmed down, whenever both the primary and secondary outboard motors are trimmed down, or when both the primary and secondary outboard motors are trimmed up. Under these three circumstances, the present invention is configured to lock the primary and secondary outboard motors to each other so that their movement about their respective steering axes is coordinated to be in tandem with each other. The present invention is also configured to disengage the primary and secondary outboard motors from each other whenever the primary outboard motor is trimmed fully downward and the secondary outboard motor is trimmed fully upward.

A flat portion is formed on an outside surface of the rod 42 to define an opening 62 that is shaped to receive the pin 60 under certain preselected circumstances. In FIGS. 2A–2D, the opening 62 is illustrated by a dashed line which represents the surface machined on an outer portion of the rod 42 which allows the pin 60 to move radially inwardly, toward axis 44, from a position in which it was in contact with outer surface 68 of the rod 42. FIG. 3 is a side view of the rod 42, showing the outer surface 68 and the formation of a slot to define an opening 62 into which the pin 60 can move. When the pin 60 moves into the opening 62, the tube 41 and rod 42 are engaged with each other and are prevented from moving axially relative to each other. When the pin 60 is moved outwardly, due to relative rotation between the rod 42 and tube 41, onto the outer surface 68 of the rod 42, the tube 41 and rod 42 are disengaged from each other and relative axial movement in a direction parallel to axis 44 is allowed to occur between the rod 42 and the tube 41.

In FIG. 2A, the primary marine propulsion unit, or outboard motor, is trimmed to its full up position. This is represented by the fact that the pin containment housing 45 is rotated approximately 71 degrees in a counter clockwise direction from a position directly vertical and above axis 44. The tube 41, which is rigidly attached to the pin containment housing 45, is also rotated approximately 71 degrees in a clockwise direction in FIG. 2A. The rod 42, which is attached to the secondary marine propulsion unit, is not rotated in FIG. 2A. The selective locking mechanism is therefore engaged.

Figure 2B:
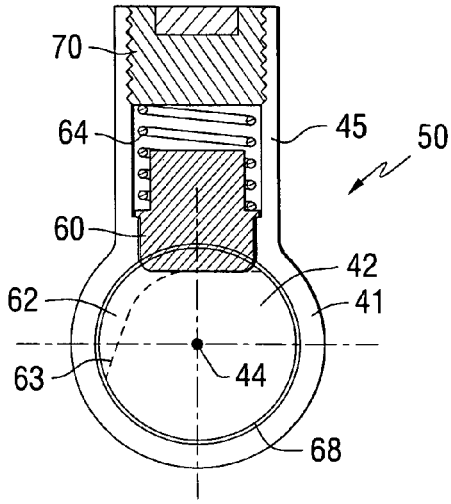
Figure 3:
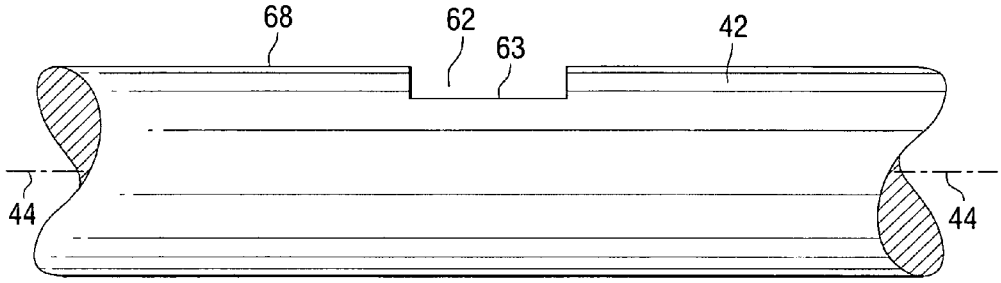

In FIG. 2B, the illustration represents a condition with both the primary and secondary marine propulsion units trimmed to their full down position. The pin containment housing 45 is illustrated in a vertical position directly above the axis 44 and the rod 42 is shown in its position that represents the secondary marine propulsion unit being in a fully trimmed down position. The pin 60 is disposed in the opening 62 and is in contact with the surface that is machined in the outer surface 68 of the rod 42 to define the opening 62. The selective locking mechanism is therefore engaged.

Figure 2C:
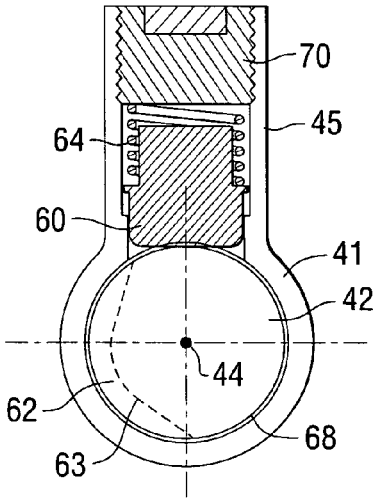

In FIG. 2C, the primary marine propulsion unit is trimmed to its full down position while the secondary marine propulsion unit, which is rigidly attached to the rod 42, is trimmed to its fully up position. This corresponds to the rotation, in a counter clockwise direction, of the rod 42 by a magnitude of approximately 75 degrees from its position shown in FIG. 2A and 2B. This causes the pin 60 to ride along the surface which forms the opening 62 and move radially outward away from axis 44. This movement of the pin 60 compresses the spring 64 and, because the pin 60 is moved out of opening 62, disengages the rod 42 from the tube 41. This disengagement permits relative axial movement between the rod and tube in directions that are parallel to axis 44.

Figure 2D:
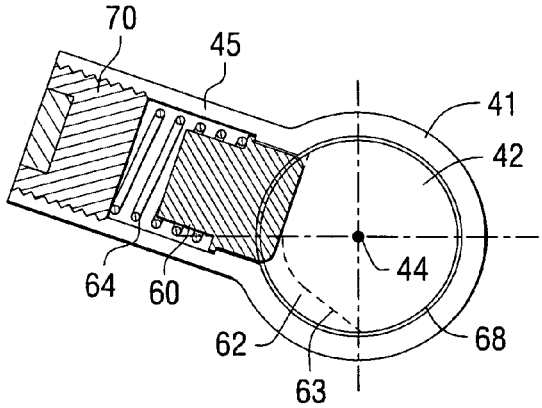

In FIG. 2D, both the primary and secondary marine propulsion units are trimmed to their full up positions. This results in the engagement of the pin 60 in the opening 62 and locks these two members together to prevent relative axial movement between them in a direction parallel to the axis 44. The selective locking mechanism is therefore engaged.

With continued reference to FIGS. 2A–2D, it can be seen that the shape of the machined surface 63, which forms opening 62, determines the relative rotational positions between the rod 42 and tube 41 that result in engagement or disengagement between these two components. The shape of the surface 63 determines the relative angular positions between the tube 41 and rod 42 that moves the pin 60 out of opening 62. This, in turn, determines the relative angular positions between the tube 41 and rod 42 which results in their engagement or disengagement with each other. Naturally, the specific shape of surface 63 and the included angle of opening 62 can be changed to result in different angles of engagement and disengagement between the primary and secondary marine propulsion units.

With reference to FIGS. 2A–2D and FIG. 3, it can be seen that the rod 42 has an opening 62 which is machined as a groove into the outer cylindrical surface 68. This results in a machined surface 63. When the pin 60, which is not illustrated in FIG. 3, moves downwardly into the opening 62, the rod 42 is locked to the tube 41 (also not shown in FIG. 3) to prevent relative movement between these components in a direction parallel to the central axis 44. It can be seen that the pin 60 prevents this axial relative movement when in the rotational positions illustrated in FIGS. 2A, 2B, and 2D. However, relative axial movement between the tube 41 and the rod 42 is permitted when the pin 60 is moved upwardly and out of opening 62, as shown in FIG. 2C.

Figure 4:
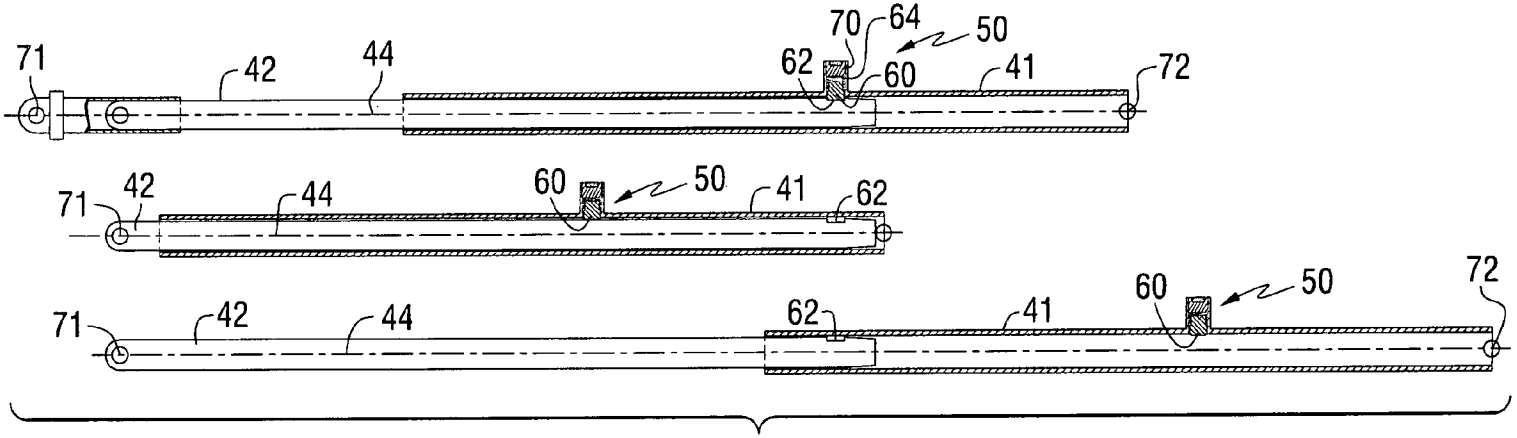
FIG. 4 shows three positional configurations of one embodiment of the present invention.

FIG. 4 shows an embodiment of the present invention in three different positional configurations. The top configuration in FIG. 4 illustrates the pin 60 disposed in the opening 62 to restrain relative axial movement between the tube 41 and the rod 42 in a direction parallel to the axis 44 when in this configuration, with the pin 60 disposed in the opening 62 of the rod 42, the positions of the ends, 71 and 72, of the connection device are fixed relative to each other and cannot move either toward each other or away from each other. However, when the rod 42 is rotated relative to the tube 41, the pin 60 can move out of the groove 62. This is illustrated in the middle illustration of FIG. 4. The pin 60 is removed from the opening 62 and this allows the rod 42 and tube 41 to move axially relative to each other in a direction parallel to the axis 44. The removal of the pin 60 from the opening 62 is accomplished by rotating the rod 42 and the tube 41 relative to each other about axis 44. The bottom illustration in FIG. 4 shows the opposite effect, but with the pin 60 also removed from the opening 62. Although the rod 42 remains disposed within the central opening of the tube 41, these two components are free to move axially relative to each other in a direction parallel to axis 44 because the pin 60 is not contained within the opening 62.

As can be seen in FIG. 4, the overall length of the connection device between its ends 71 and 72 is significantly variable when the pin 60 is removed from the opening 62 (middle and bottom illustrations), but is fixed at a preselected length when the pin 60 is disposed in the opening 62 (top illustration). In the embodiment of the present invention shown in FIG. 4, it can be seen that, under certain circumstances, the rod 42 can be removed from the tube 41. For example, if the ends, 71 and 72, are moved farther apart than they are shown in the bottom illustration of FIG. 4, the rod 42 may come completely out of the tube 41. If this potential removal of the rod 42 from the tube 41 is undesirable, it can be prevented by using the preferred embodiment of the present invention described below in conjunction with FIG. 5.

Figure 5:
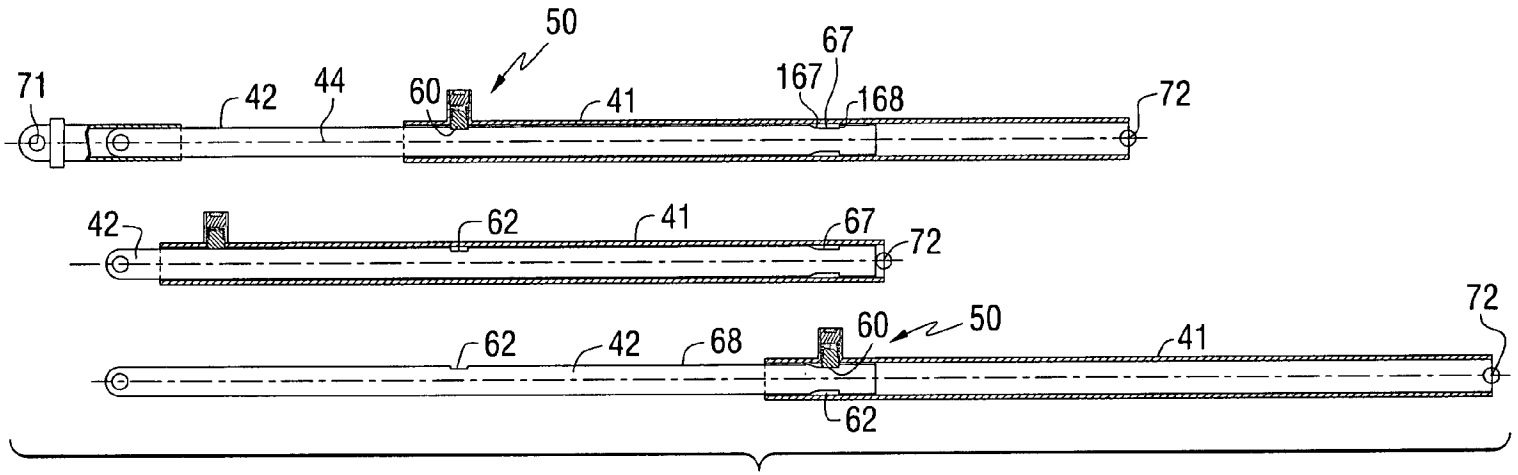
FIG. 5 shows three positional representations of a preferred embodiment of the present invention.

FIG. 5 shows an alternative embodiment of the present invention which places the selective locking mechanism 50 closer to the left end of the tube 41 than the embodiment shown in FIG. 4. The embodiment shown in FIG. 5 is similar to that shown in FIG. 4, but with an additional opening 67 formed near one end of the rod 42. The opening 67 is formed by machining a circumferential groove with a ramped end 167 and a perpendicular end 168. If extended fully, with ends 71 and 72 moved apart to their maximum intended distance, the pin 60 moves down the ramped surface 167 into opening 67 and is stopped from further axial movement relative to the rod 42 by the perpendicular surface at the other end 168. From this position, the rod 42 and tube 41 are rotatable relative to each other, but ends 71 and 72 are not able to be moved apart by a further degree. The ends, 71 and 72, can be moved toward each other from this position because of the sloped surface 167. The pin 60 can move up this sloped surface 167 and slide along the outer surface 68 of the rod. The purpose of opening 67 formed in the end of rod 42 is to prevent the complete disengagement of the tube and rod from each other. This complete disengagement could be possible with the embodiment shown in FIG. 4.

Figure 6:
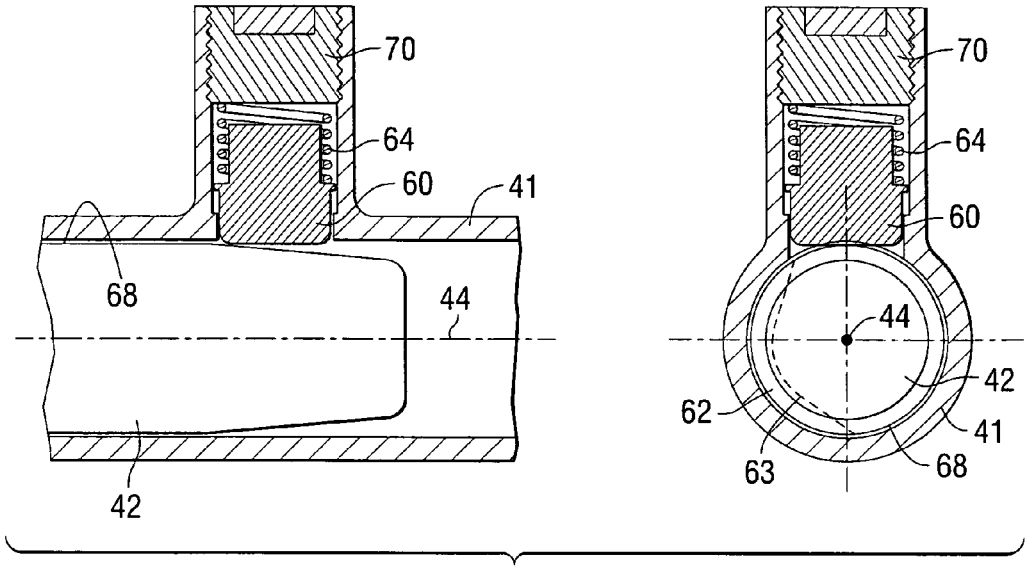
FIG. 6 shows a series of sequential section views showing the operation of an embodiment of the present invention.
Figure 7:
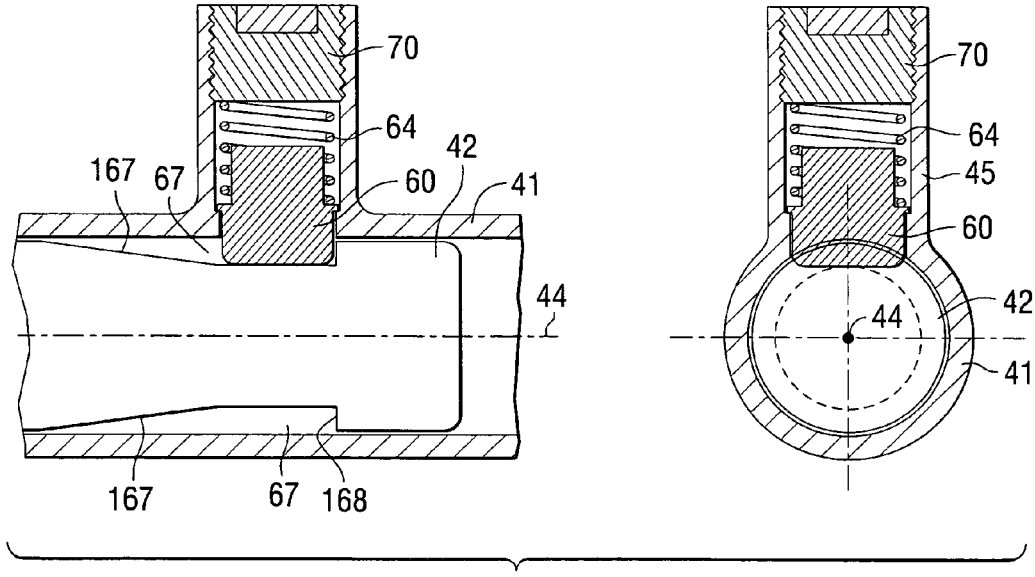
FIG. 7 shows sequential section views of a preferred embodiment of the present invention.

FIGS. 6 and 7 are side section views of the embodiments shown in FIGS. 4 and 5, respectively. In FIG. 6, the pin 60 is in contact with a tapered end portion at the distal end of the rod 42. As described above in conjunction with FIG. 4, continued movement of the rod 42 toward the left in relation to the tube 41 can cause a complete disengagement of these two components. In certain embodiments of the present invention, this potential disengagement presents no problem. The tapered end of the rod will allow the pin to slide back onto the rod.

With continued reference to FIG. 6, the illustration on the right side of the figure shows the relative position of surface 63 which forms opening 62. In the left illustration in FIG. 6, that opening 62 is located toward the left of the illustration and not shown in that particular representation.

FIG. 7 illustrates a side section view of the embodiment of the present invention described above in conjunction with FIG. 5. Toward the distal end of the rod 42, the opening 67, or circumferential slot, is formed with a tapered surface 167 and a perpendicular surface 168. The tapered surface 167 allows the pin 60 to slide into and out of the slot 67. The perpendicular surface 168 prevents the rod 42 from being removed completely from its position within the tube 41.

With continued reference to FIGS. 6 and 7, it should be understood that they represent only two of numerous alternative embodiments relating to the distal end of the rod 42 and its relationship to the pin 60.

Figure 8:
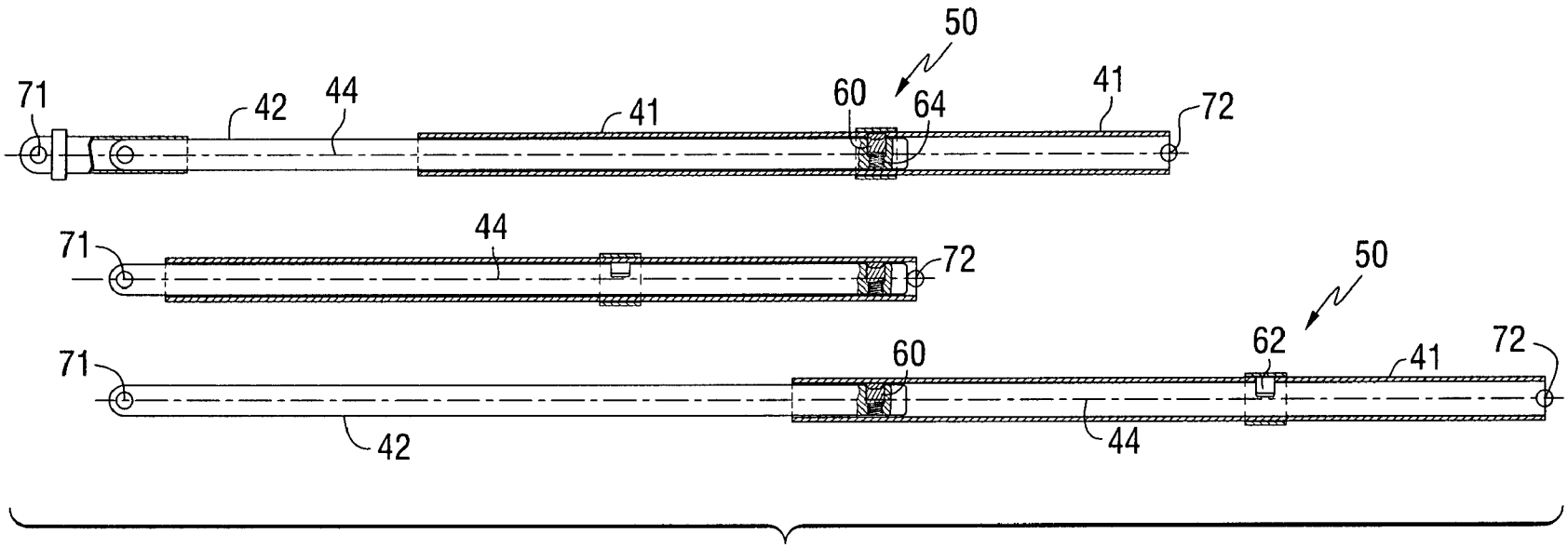
FIG. 8 shows an alternative embodiment of the present invention in three views showing different positional configurations of its components.

FIG. 8 shows an alternative embodiment of the present invention in which the selective locking mechanism 50 comprises a pin 60 which is supported by the rod 42 and an opening 62 which is formed in the tube 41. In other words, the operation of the pin 60, the spring 64, and the opening 62 are essentially reversed in comparison to the embodiments described above in conjunction with FIGS. 4–7. The top illustration in FIG. 8 shows the locked position, or engaged, of the selective locking mechanism 50 and the fixed length of the connection device between its ends, 71 and 72. The central illustration in FIG. 8 shows an unlocked, or disengaged, configuration of the selective locking mechanism in which the tube 41 and rod 42 are moved to decrease the overall length between the ends 71 and 72. The bottom illustration in FIG. 8 shows the expanded configuration, wherein the selective locking mechanism 50 is unlocked and the tube 41 and rod 42 are extended apart to move the ends, 71 and 72, to approximately their maximum distance from each other.

Figure 9:
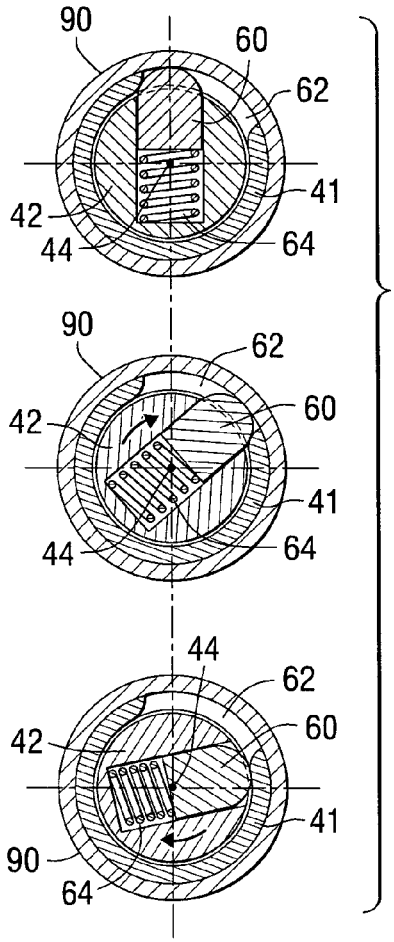
FIG. 9 shows three sectional views of sequential positions during operation of an alternative embodiment of the present invention.

FIG. 9 is a group of section views showing the various positions of the pin 60 and opening 62 relative to each other in the embodiment described above in conjunction with FIG. 8. In the embodiment illustrated in FIG. 9, an outer containment tube 90 prevents the pin 60 from moving beyond its desired position in a radially outward direction from the central axis 44.

In the top illustration of FIG. 9, the pin 60 is urged upwardly by the spring 64 so that it extends into the opening 62 formed in the tube. In the central illustration of FIG. 9 the rod 42 is rotated in a clockwise direction to place the pin 60 at an extreme circumferential position relative to the opening 62. However, it should be understood that the pin 60 remains in the opening 62 and continues to lock the tube 41 relative to the rod 42 and prevent axial movement therebetween in a direction parallel to the central axis 44. The bottom illustration in FIG. 9 shows the arrangement after continued rotation of the rod 42 causes the pin 60 to moved radially inwardly against the force of the spring 64. This removes the pin 60 from the opening 62 and allows axial movement between the rod 42 and the tube 41 in a direction parallel to the central axis 44.

Figure 10:
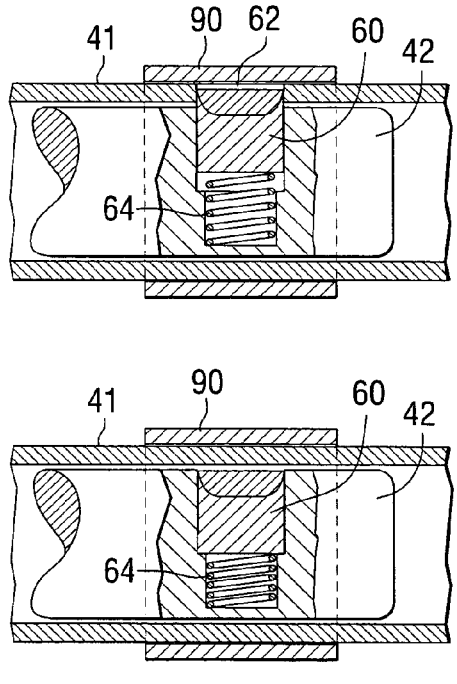
FIG. 10 are side sectional views of an alternative embodiment of the present invention during operation of its selective locking mechanism.

FIG. 10 shows side section views of the embodiment of the present invention described above in conjunction with FIGS. 8 and 9. In the top illustration of FIG. 10, the pin 60 is moved into the opening 62 of the tube 41. This locks the tube 41 and the rod 42 together to prevent axial movement therebetween. In the bottom illustration of FIG. 10, the tube 41 and the rod 42 have been rotated relative to each other about their central axis and the pin 60 has been moved downwardly out of the opening and against the resistance of the spring 64. This unlocks the selective locking mechanism and allows axial movement between the tube 41 and the rod 42. As described above, the outer containment tube 90 prevents the pin 60 from moving radially in an outward direction beyond the desired maximum position. It should also be understood that the pin 60 can be made in a shape other than round to prevent rotation. The radius of the pin edge and the tube 41 are shaped to enhance the smooth operation of the device.

When the connection device of the present invention is attached to primary and secondary components of a marine propulsion system, such as primary and secondary outboard motors, the primary and secondary components are selectively locked together to prevent axial extension or contraction of the connection device. This forces the primary and secondary outboard motors to move in tandem with each other when either one is rotated about its respective steering axis. For example, this condition occurs when both of the marine propulsion devices are either trimmed downwardly into their respective operative positions or tilted upwardly out of the water. However, if the secondary marine propulsion device (i.e. the "kicker") is tilted upwardly out of the water while the other marine propulsion device is in its operative position, the relative rotation of the tube and rod of the present invention will free the tube and rod from axial attachment to each other and allow axial movement therebetween. Therefore, if the secondary propulsion device is trimmed upwardly while the primary propulsion device is trimmed into its operative position, steering of the operative outboard motor will not be adversely affected by restriction caused by the locked connection device which is also attached to the secondary marine propulsion device.

In a particularly preferred embodiment of the present invention, the first predetermined rotational position between the rod 42 and the tube 41, in which the two components are locked together, includes the positions illustrated in FIGS. 2A, 2B, and 2D. These include the situations when the primary outboard motor is trimmed up and the secondary is trimmed down, when both the primary and secondary outboard motors are trimmed down, and when both the primary and secondary outboard motors are trimmed up, respectively. The second predetermined rotational position relative to each other for the rod 42 and tube 41, in which these components are disengaged from each other, is when the primary outboard motor is trimmed down while the secondary outboard motor is trimmed up, as represented in FIG. 2C. However, it should be clearly understood that the shape and location of surface 63 relative to the position of the pin containment housing 45 will determine the limitations of the first and second predetermined rotational positions of the rod 42 and tube 41 relative to each other. In the description above, certain desirable positions for engagement and disengagement of the primary and secondary outboard motors were selected for a particularly preferred embodiment of the present invention and to provide a means by which the present invention can be fully and clearly described. When a system, such as that described in U.S. Pat. No. 6,659,817, is used to lock the secondary outboard motor in a particular position when it is trimmed up, it is beneficial to have the tie bar disengage as illustrated in FIG. 2C. If no such locking system is used with regard to the secondary outboard motor, alternative configurations of the opening 62 and surface 63 relative to the possible positions of the pin 60 can be selected.

The present invention provides a connection device which automatically disconnects the two propulsion systems from each other when the secondary outboard motor is trimmed upwardly while the primary outboard motor remains in its operative position. It also automatically locks the two propulsion systems together when they are either both trimmed downwardly into their operative positions or trimmed upwardly out of the water. This automatic connection and disconnection is beneficial because it allows the operator to benefit from the connection or disconnection between the two propulsion devices without having to manually intervene in making a change in the connection relationship between the tube and rod.

Although the present invention has been described in terms of a connection between primary and secondary marine propulsion units, it should be understood that the connection device can be attached between a marine propulsion unit and any other component, such as a source of motive power. A manual source of motive power is described in U.S. Pat. No. 4,559,889 in which a foot pedal is attached with a tie bar to a single marine propulsion device. It should be also understood that powered steering mechanisms are available on the market in which the powered steering mechanism typically comprises an electrical motive device which can be attached to an outboard motor to cause it to move about its steering axis in response to movement of a remote control mechanism that is controlled by the operator.

Although the present invention has been described in considerable detail and illustrated to show several preferred embodiments, it should be understood that alternative embodiments are also within its scope.

I claim:

1. A connection device for a marine propulsion system, comprising:

a first member;

a second member, said first and second members being configured to be disposed in movable association with each other in a direction generally parallel to a first axis, said first and second members being rotatable relative to each other about said second axis; and a selective locking mechanism configured to prevent relative movement between said first and second members in a direction parallel to said first axis when said first and second members are in a first predetermined rotational position relative to each other about said second axis, said locking mechanism being configured to permit relative movement between said first and second members in a direction parallel to said first axis when said first and second members are in a second predetermined rotational position relative to each other about said second axis.

2. The connection device of claim 1, wherein:

said first and second axes are coaxial.

3. The connection device of claim 1, wherein:

said selective locking mechanism comprises a pin which is shaped to be received in an opening to prevent said relative movement between said first and second members in said direction parallel to said first axis when said first and second members are in said first predetermined rotational position relative to each other about said second axis.

4. The connection device of claim 3, wherein:

said pin is supported by said first member and said opening is formed in said second member.

5. The connection device of claim 3, wherein:

said pin is supported by said second member and said opening is formed in said first member.

6. The connection device of claim 3, wherein:

said opening is a groove which is shaped to receive said pin.

7. The connection device of claim 3, wherein:

said opening is a flat portion formed in a rounded surface, said flat portion being shaped to receive said pin.

8. The connection device of claim 3, further comprising:

a resilient member associated with said pin to urge said pin in a direction that moves said pin into said opening when said pin is aligned with said opening.

9. The connection device of claim 1, wherein:

said first member is a rod and said second member is a tube, said rod being disposable within said tube.

10. The connection device of claim 1, wherein:

said first member is attachable to a first marine propulsion device.

11. The connection device of claim 10, wherein:

said second member is attachable to a second marine propulsion device.

12. The connection device of claim 10, wherein:

said second member is attachable to a source of motive force.

13. A connection device for a marine propulsion system, comprising:

a first member;

a second member, said first and second members being connected to each other and configured to be disposed in movable association with each other, said first member being attachable to a first component of said marine propulsion system, said second member being attachable to a second component of said marine propulsion system; and a selective locking mechanism associated with said first and second members, said first and second members being rotatable relative to each other about a second axis, said selective locking mechanism being configured to prevent relative movement between said first and second members in a direction parallel to a first axis when said first and second members are in a first predetermined rotational position relative to each other about said second axis, said locking mechanism being configured to permit relative movement between said first and second members in a direction parallel to said first axis when said first and second members are in a second predetermined rotational position relative to each other about said second axis.

14. The connection device of claim 13, wherein:

said first component of said marine propulsion system is a first outboard motor and said second component of said marine propulsion system is a second outboard motor.

15. The connection device of claim 13, wherein:

said first component of said marine propulsion system is a first outboard motor and said second component of said marine propulsion system is a source of motive force which causes said first outboard motor to move about its steering axis.

16. The connection device of claim 13, wherein:

said first and second axes are coaxial.

17. The connection device of claim 16, wherein:

said selective locking mechanism comprises a pin which is shaped to be received in an opening to prevent said relative movement between said first and second members in a direction parallel to said first axis when said first and second members are in a first predetermined rotational position relative to each other about said second axis.

18. The connection device of claim 17, further comprising:

a resilient member associated with said pin to urge said pin in a direction that moves said pin into said opening when said pin is aligned with said opening.

19. The connection device of claim 18, wherein:

said first member is a rod and said second member is a tube, said rod being disposable within said tube.

20. A connection device for a marine propulsion system, comprising:

a rod which is attachable to a first component of said marine propulsion system;

a tube which is attachable to a second component of said marine propulsion system, said rod being movable within said tube in a direction which is generally parallel to a central axis of said tube, said tube and said rod being rotatable relative to each other about said central axis of said tube; and a selective locking mechanism associated with said connection device, said selective locking mechanism being configured to prevent movement of said tube and said rod relative to each other in a direction which is generally parallel to said central axis when said first and second components of said marine propulsion system are disposed in a first positional relationship relative to each other, said selective locking mechanism being configured to permit movement of said tube and said rod relative to each other in said direction which is generally parallel to said central axis when said first and second components of said marine propulsion system are disposed in a second positional relationship relative to each other, said selective locking mechanism comprising a pin supported by said rod and an opening formed in said pin.

21. The connection device described in claim 20, wherein:

said first component of said marine propulsion system is a first marine propulsion device.

22. The connection device described in claim 20, wherein:

said first marine propulsion device is a first outboard motor.

23. The connection device described in claim 21, wherein:

said second component of said marine propulsion system is a second marine propulsion device.

24. The connection device described in claim 20, wherein:

said selective locking mechanism comprises a pin supported by said tube and an opening formed in said rod.

25. The connection device described in claim 20, further comprising:

a spring associated with said pin to urge said pin toward said opening when said pin is aligned with said opening.

26. The connection device described in claim 25, wherein:

said pin is movable into said opening when said first and second components of said marine propulsion system are disposed in said first positional relationship relative to each other.

27. The connection device described in claim 26, wherein:

said first and second components of said marine propulsion system are disposed at generally similar trim angles relative to a marine vessel when said first and second components of said marine propulsion system are disposed in said first positional relationship relative to each other.

* * * * *